United States Patent [19]

Salmon et al.

[11] Patent Number: 5,018,602

[45] Date of Patent: May 28, 1991

[54] REDUCTION OF NOISE AND VIBRATION IN AN ELEVATOR CAR BY SELECTIVELY REDUCING AIR TURBULENCE

[75] Inventors: John K. Salmon, South Windsor; Young S. Yoo, Avon, both of Conn.

[73] Assignee: Otis Elevator Company, Farmington, Conn.

[21] Appl. No.: 497,054

[22] Filed: Mar. 21, 1990

[51] Int. Cl.[5] ..... B66B 11/02

[52] U.S. Cl. ..... 187/1 R; 187/94

[58] Field of Search ..... 187/1 R, 94

[56] References Cited

U.S. PATENT DOCUMENTS

| | | | |
|---|---|---|---|
| 1,107,191 | 8/1914 | Balliet | 187/94 |
| 1,404,832 | 1/1922 | Butler et al. | 187/1 R |
| 2,017,372 | 10/1935 | Morrison | 187/1 R |
| 2,190,330 | 2/1940 | Martine | 187/1 R |
| 3,040,295 | 6/1962 | Linville | 187/1 R X |
| 3,945,468 | 3/1976 | Miura et al. | 187/1 R |
| 4,677,779 | 7/1987 | Rodriguez | 187/1 R X |

FOREIGN PATENT DOCUMENTS

| | | |
|---|---|---|
| 52-20545 | 2/1977 | Japan . |
| 1313797A | 5/1987 | U.S.S.R. . |

*Primary Examiner*—Joseph E. Valenza
*Assistant Examiner*—Dean A. Reichard
*Attorney, Agent, or Firm*—William W. Jones

[57] ABSTRACT

Air flow in an elevator hoistway is directed to the sides of the elevator car in order to avoid creating air turbulence in the path of travel of the counterweight assembly and in the area of hoistway doors and sills. Control of the air flow is accomplished with pitched air deflectors mounted on the roof of the car. Each air deflector comprising a shear panel and a pitched panel serves to deflect air in the hoistway away from the counterweights and to one side of the car. Shear panels are mounted on the top and bottom of the car to cover the landing sills as the car moves past floors in the hoistway whereby air is sheared away from the sills and air intercepted by the car travel is kept from passing hoistway elements which induce noise and vibration of the car.

7 Claims, 1 Drawing Sheet

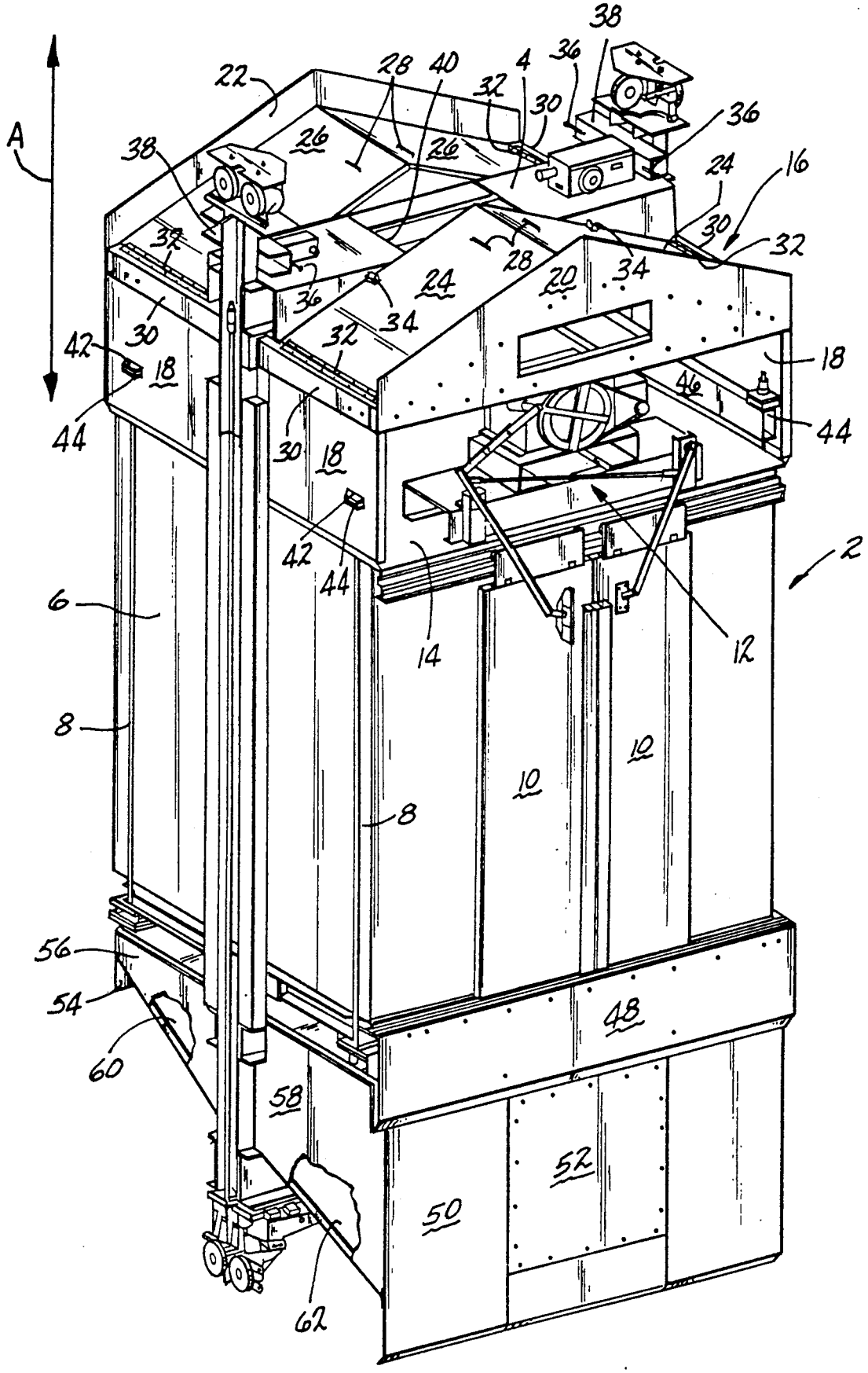
A
22
26
28
40
4
32
30
36
38
24
16
34
20
18
42
44
46
2
6
8
14
12
10
56
54
60
58
48
52
50
62

REDUCTION OF NOISE AND VIBRATION IN AN ELEVATOR CAR BY SELECTIVELY REDUCING AIR TURBULENCE

DESCRIPTION

1. Technical Field

This invention relates to an elevator system which produces a smoother, quieter ride at high speed travel rates, and more particularly, to an elevator system having an aerodynamically improved car assembly.

2. Background Art

High speed elevator systems are necessary in modern high-rise buildings in order to reduce passenger trip time. Such elevators commonly travel at speeds of one thousand feet per minute and higher. When the elevator car travels at such high speeds, it is important that car noise and vibration be kept at a minimum to ensure passenger comfort. New car suspension assemblies and rail guiding improvements can achieve very quiet and smooth rides over the majority of the path of travel of the car in the hoistway, however, air turbulence will result in the hoistway due to the confined nature of a hoistway, and the high rates of speed at which the elevator car and counterweight move through the hoistway. Such air turbulence is created both by the car and by the counterweight. Car-induced turbulence can cause noise and vibration in the car as the latter passes each landing sill and hoistway door; and car-induced plus counterweight-induced turbulence can cause noise and vibration in the car when the car and counterweight pass each other in the hoistway. This invention is directed toward the reduction of noise and vibration in the car caused by movement of the car through the hoistway and air turbulence created thereby.

U.S. Pat. No. 3,945,468 granted March 23, 1976 to Miura, et al. concerns the reduction of noise and car vibration in an elevator. This patent suggests the use of a long skirt below the car door on the hoistway landing side of the car to reduce sill vibration and noise; and the use of guide plates mounted on the top and bottom of the elevator car to deflect air away from the car. A problem with the car guide plates in the aforesaid patent is that they deflect air toward the counterweight assembly and the hoistway doors and sills. Thus the guide plates will create a turbulent air condition in the path of travel of the counterweight. When the counterweight passes through this turbulence it will be passing the car and will reflect the turbulence back toward the car. This type of arrangement will increase noise and vibration in the car as the car and counterweight pass each other in the hoistway.

DISCLOSURE OF THE INVENTION

This invention relates to the reduction of noise and vibration caused by movement of the car through the hoistway. Air deflectors are mounted on the top and bottom of the car assembly frame to ensure that air flow and turbulence created by the car's movement is not directed against the counterweight. Air turbulence caused by the car passing the landing door sills is also minimized. The air deflectors above the car include front and back panels which extend vertically from the front and back walls of the car and which capture air and divert it away from the landing door and opposite walls of the hoistway. Thus air is diverted away from the counterweight and from the landing door sills as the car rises in the hoistway. Inwardly adjacent to the front and back panels are downwardly and outwardly diverging sets of side deflector panels which meet at a central ridge extending from the front of the car to the back. The side deflector panels direct air flow from above the car down along the sides thereof so that air turbulence around the car is minimized and restricted to the sides of the car away from the landing sills and counterweight.

The bottom of the car assembly frame is provided with front and rear vertical panels which sweep air away from the landing sills and counterweight. The air is deflected toward the center crossbeam of the car frame from both the front and back by inclined front and rear bottom panels. At the bottom car frame crossbeam the flow of air spills off to the sides of the car toward the side walls of the hoistway.

It is therefore an object of this invention to provide an improved elevator car construction particularly for use in high-speed elevator systems.

It is a further object of this invention to provide an elevator car of the character described which affords passengers a smoother and quieter ride.

It is an additional object of this invention to provide an elevator car of the character described which includes upper and lower air deflectors mounted thereon to control air flow past the car and minimize air turbulence in the hoistway.

These and other objects and advantages of the invention will become more readily apparent from the following detailed description of a preferred embodiment of the invention when taken in conjunction with the accompanying drawing which is a perspective view of an elevator car assembly fitted with air deflectors in accordance with this invention.

BEST MODE FOR CARRYING OUT THE INVENTION

Referring to the drawing, the elevator car assembly is denoted generally by the numeral 2, and includes a frame 4 in which the car 6 is suspended by means of pendulum rods 8 connecting the car 6 to the frame 4 at each corner of the car as disclosed in U.S. Pat. No. 4,899,852 granted Feb. 13, 1990, which is incorporated by reference herein in its entirety. The front or elevator landing side of the car 6 includes the car doors 10 through which passengers enter and exit the car. A conventional door operating mechanism 12 is mounted on the roof 14 of the car 6. The arrow A behind the car 6 indicates the path of travel of the counterweight assembly in the hoistway. The top air deflector assembly 16 is mounted above the car roof 14, and includes side walls 18, an upper front panel 20 and back panel 22, and front and back side top cover panels 24 and 26, respectively. The cover panels 24 and 26 each have handles 28 and are connected to a top corner channel 30 by hinges 32. Each cover panel has a catch 34 which engages a catch pin 36 mounted at ends of channels 38 mounted on the frame 4. This arrangement allows access to the roof 14 of the car if necessary. The car cables pass through an opening 40 in the frame 4. The front panel 20 is open to allow easy access to the door actuator 12 for servicing and adjustment. The side walls 18 are provided with openings 42 which receive tabs 44 mounted on side channel portions 46 of the frame 4.

Below the door sill 48 is a front shearing panel 50 which includes a removable access panel 52 connected thereto. A rear shearing panel 54 is also mounted below the back wall of the car 6 which faces the path of travel of the counterweight assembly. Side panels 56 and 58 depend downwardly below the sides of the car 6 and bottom panels 60 and 62 extend between the side panels 56 and 58. The bottom panels 60 and 62 are angled downwardly and forwardly toward the front of the car 6, and the front and rear shear panels 54 and 50 extend downwardly past the bottom panels 60 and 64.

The deflectors operate in the following manner. When the car 6 moves upwardly in the hoistway, the front and rear panels 20 and 22 shear air away from the landings and counterweight path of travel respectively. Thus no air turbulence is created at the landing sills and at the counterweight as they pass the car 6. The air flow above the car 6 is directed onto the panels 24 and 26 and thence toward the sides of the car 6 where there are no landing sills or counterweights. The result is a minimal counterturbulence in the hoistway which is directed back at the car 6. A quieter and smoother ride is thus produced in the up direction.

When the car 6 moves downwardly in the hoistway, the panels 50 and 54 shear air away from the landings and counterweight path of travel. The lower panels 60 and 62 cascade air directly beneath the car 6 away from the counterweight path of travel and toward the center of the car frame. The air beneath the car 6 thus rolls under the car 6 near the front side thereof and away from the counterweight path of travel. Minimal air turbulence is thus reflected back at the car 6 by the sills or counterweight.

It will be readily appreciated that the air deflectors on the top and bottom of the elevator cars are designed to minimize vibration and noise caused by reflected air turbulence from the sills and counterweight by directing air flow away from the front and back walls of the hoistway. The air turbulence created by the car moving in the hoistway is directed to the sides of the hoistway where turbulence reflecting protuberances in the hoistway are negligible. The deflectors are light weight and allow ready access to the roof and underside of the car for servicing and maintenance. The front and rear shearing panels minimize the passage of air displaced by the car's passage through the hoistway past the sills and counterweight. The various air deflectors and shearing panels are supported by the car frame, rather than the cab, and essentially prevent direct impingement of air on the cab. Thus neither the air itself nor the loads imposed upon the panels are directly applied to the cab.

Since many changes and variations of the disclosed embodiment of the invention may be made without departing from the inventive concept, it is not intended to limit the invention otherwise than as required by the appended claims.

What is claimed is:

1. An elevator car assembly comprising:

a. a frame;

b. a car disposed in said frame;

c. suspension means mounting said car in said frame;

d. upper air deflector means mounted on said frame above said car and operable to shield said car from air impingement during upward travel of said car and frame, said upper air deflector means comprising pairs of pitched air deflector panels which meet at a vertical midplane of said car and slope downwardly away from each other toward side walls of said car, said air deflector panels being operable to deflect air flow away from a counterweight path of travel adjacent to said assembly; and e. lower air deflector means mounted on said frame below said car and operable to shield said car from air impingement during downward travel of said car and frame.

2. The elevator car assembly of claim 1 wherein said upper air deflector means further comprises vertical air shear panels mounted on each side of said air deflector panels, and operable to shear air away from said counterweight path of travel and an elevator landing side of said assembly, and direct air flow onto said air deflector panels.

3. The elevator car assembly of claim 1 wherein said lower air deflector means includes spaced vertical shear panels adjacent said counterweight path of travel and said elevator landing side of said assembly and bottom air flow panels extending between said vertical shear panels to direct air flow away from said counterweight path of travel and said elevator landing side of said assembly.

4. The elevator car assembly of claim 1 wherein said air deflector panels are pivotally connected to said car side walls whereby said air deflector panels can be pivoted away from each other to gain access to a top panel on the car.

5. The elevator car assembly of claim 4 wherein there are two pairs of cooperating air deflector panels, one pair being disposed on the car on each of opposite sides of the frame.

6. The elevator car assembly of claim 5 further comprising cooperating latching means on said air deflector panels and the frame for temporarily holding the air deflector panels in substantially vertical positions to maintain access to the top panel of the car.

7. The elevator car assembly of claim 4 wherein said air deflector panels are upwardly offset from the to panel of the car to overlie auxiliary car operating equipment mounted on the top panel of the car.

* * * * *

UNITED STATES PATENT AND TRADEMARK OFFICE

CERTIFICATE OF CORRECTION

PATENT NO. : 5,018,602

DATED : May 28, 1991

INVENTOR(S) : John K. Salmon and Young S. Yoo

It is certified that error appears in the above-identified patent and that said Letters Patent is hereby corrected as shown below:

Column 4, line 50, delete the word "to" and insert the word --top-- in lieu therefor.

Signed and Sealed this

Thirteenth Day of October, 1992

*Attest:*

DOUGLAS B. COMER

*Attesting Officer*

*Acting Commissioner of Patents and Trademarks*